United States Patent [19]

Hank et al.

[11] Patent Number: 4,765,241

[45] Date of Patent: Aug. 23, 1988

[54] ARRANGEMENT FOR NORMALIZED INDICATION OF PRINTING INK SUPPLY HAVING ROLLER WITH ADJUSTABLE SPEED

[75] Inventors: Dietrich Hank; Heinz Skiera; Gerd Zimmermann, all of Leipzig, German Democratic Rep.

[73] Assignee: VEB Kombinat Polygraph "Werner Lamberz" Leipzig, Leipzig, German Democratic Rep.

[21] Appl. No.: 897,844

[22] Filed: Aug. 18, 1986

[30] Foreign Application Priority Data

Nov. 6, 1985 [DD] German Democratic Rep. ..... 2825361

[51] Int. Cl.[4] ..... B41F 31/06; B41F 31/14; B41F 31/34

[52] U.S. Cl. ..... 101/350; 101/DIG. 6

[58] Field of Search ..... 101/349, 350, 351, 352, 101/148, DIG. 6, 207–210

[56] References Cited

FOREIGN PATENT DOCUMENTS 125618 5/1977 German Democratic Rep. .

*Primary Examiner*—J. Reed Fisher

*Attorney, Agent, or Firm*—Michael J. Striker

[57] ABSTRACT

A method of providing a normalized indication of the printing ink supply to a printing station of a printing machine, which includes main and ductor roller motors respectively operating at a first and a second speed, comprises generating first and second pulse trains having first and second pulse frequencies respectively proportional to the first and second speeds; forming a ratio of the first and second frequencies at predetermined time intervals; storing the thus formed ratio; and displaying the stored ratio. An arrangement for performing the above method includes first and second incremental digital transducers, a first counter having a counting input connected through a first gate circuit to an output of the first transducer and an output which is activated when a settable counting volume has been reached, a second counter having a counting input connected through a second gate circuit to the output of the second transducer and an output connected to a digital storage device, and a triggering circuit having inputs connected to the outputs of the first transducer and of the first counter, the triggering circuit generating a start/stop signal and a resetting signal which are respectively supplied to control inputs of the first and second gate circuits and to resetting inputs of the first and second counters.

2 Claims, 1 Drawing Sheet

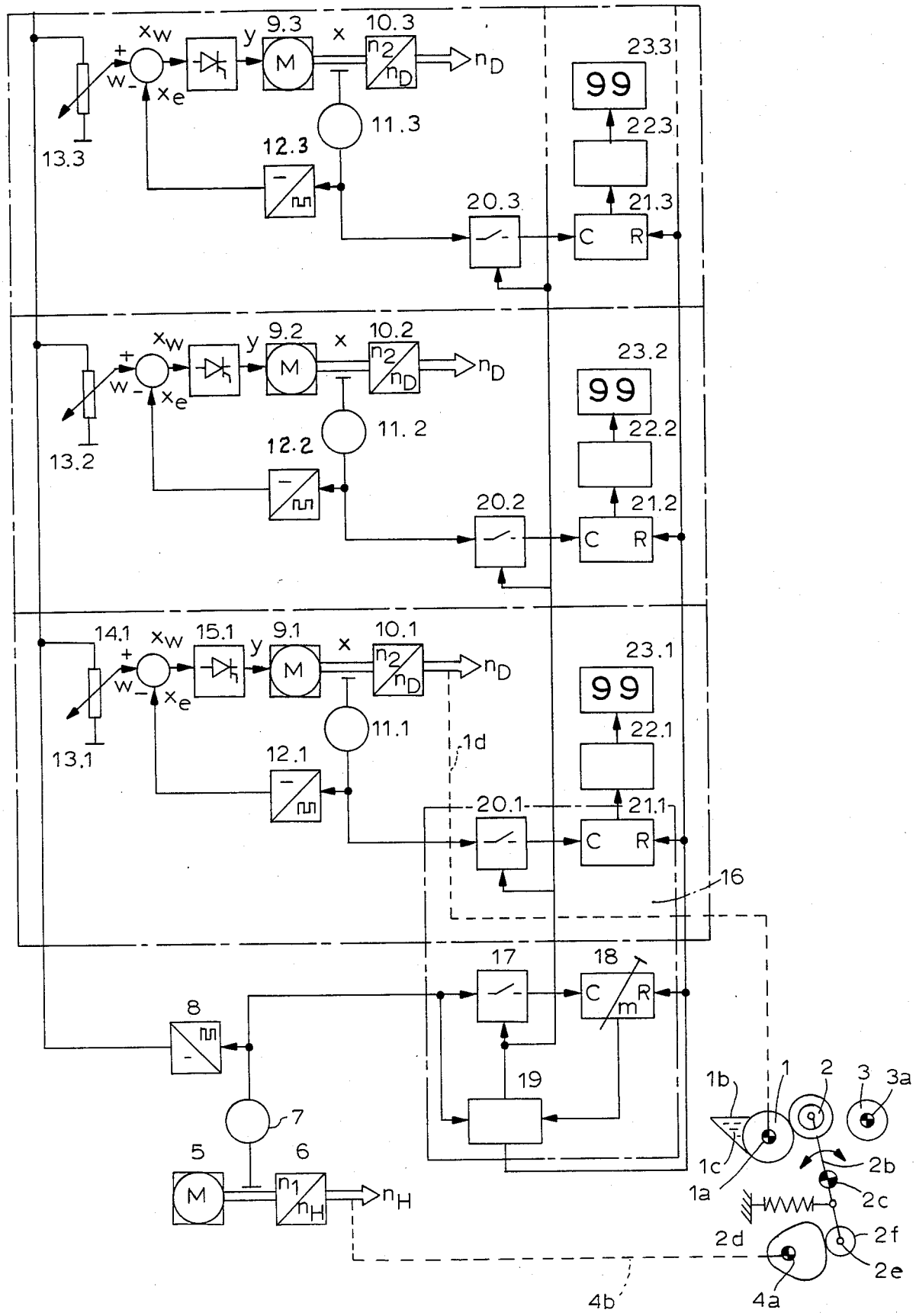
9.3
10.3
23.3
99
22.3
21.3
11.3
12.3
13.3
20.3
9.2
10.2
23.2
22.2
21.2
11.2
12.2
13.2
20.2
14.1
15.1
9.1
10.1
23.1
22.1
21.1
11.1
12.1
13.1
20.1
1d
16
17
18
19
8
7
5
6
1b
1
2
3
3a
1c
1a
2b
2c
2d
2f
2e
4a
4b

ARRANGEMENT FOR NORMALIZED INDICATION OF PRINTING INK SUPPLY HAVING ROLLER WITH ADJUSTABLE SPEED

BACKGROUND OF THE INVENTION

The present invention relates to supplying printing inks to printing machines in general, and more particularly to a method of and an arrangement for normalized indication of printing ink supply to such machines.

There are already known various constructions of printing machines, among them rotary printing machines, such as offset printing machines, which are capable of printing in several colors. The present invention is directed especially but not exclusively to printing machines of the last-mentioned type, particularly such using a printing ink lifting element principle or a printing ink film transfer principle, both of which principles will be discussed in some detail below, for transferring the respective printing ink at a respective printing station from a ductor roller, which is partially immersed in a supply of the respective printing ink that is contained in a ductor box, to an associated first printing ink transfer roller.

The task of a printing ink supplying system in a printing machine is to withdraw the printing ink from a supply container (ductor box) and to feed the withdrawn printing ink to a printing ink spreading system at a rate which is metered in dependence on the requirements of the printing block.

The first of the principles mentioned above, which involves the use of a lifting element, especially a lifting roller, for discontinuous printing ink transfer from the ductor into the printing ink spreading system is being used, because of the high accuracy of the printing ink transfer, even in modern printing machines which operate at high speeds, especially in offset printing machines.

As is well known in this context, the lifting roller conducts a swinging motion so that it alternatively contacts the ductor roller and the first printing ink transfer roller of the printing ink spreading system. As a result of this swinging motion and the resulting temporary contact of the lifting roller with the ductor roller at one of the reversal points of the swinging motion of the lifting roller, a narrow strip of printing ink, which extends over the entire printing width of the printing machine and has a predetermined thickness and a given length in the circumferential direction of the lifting roller, is transferred from the ductor roller to the lifting roller; on the other hand, the amount of printing ink contained in this narrow printing ink strip is subsequently transferred from the lifting roller to the first printing ink transfer roller of the ink spreading system as the lifting roller contacts the first printing ink transfer roller at the other reversal point of the lifting roller swinging motion path.

When operating in accordance with the second-mentioned one of the above principles which involves the use of a printing ink transfer roller cooperating with the ductor roller, the printing ink is being continuously supplied to the printing ink spreading system. In this case, the printing ink transfer roller, which rotates at the same circumferential speed as the printing plate cylinder, continuously picks up a partial printing ink layer from the printing ink layer presented by the ductor roller, and transfers this partial printing ink layer to a following elastic roller of the printing ink spreading system. A gap is provided between the transfer roller and the ductor roller.

As will be shown later, the printing ink supply to the printing ink spreading system is dependent, in the final analysis, on the ratio of the rotational speed of the ductor roller driving motor to the rotational speed of the main driving motor of the printing machine. The rotational speed of the ductor roller driving motor is the parameter which is adjusted by the operator of the printing machine in order to adjust the supply of the printing ink per printing operation to the printing ink spreading system of the printing machine or of the printing station.

When the rotational speed of the main driving motor of the printing machine is changed, a control circuit incorporated in the printing machine control circuitry provides for a commensurate, that is, for relatively the same, change in the rotational speed of the ductor roller. In this manner, the amount of the printing ink transferred from the ductor roller to the printing ink spreading system is not influenced by such a change in the rotational speed of the main machine driving motor. Such ductor drives which are adjustable as far as their rotational speed is concerned and which are also regulated with respect to their rotational speed are generally known.

It is also known to construct the control system of the printing machine as to enable the printing machine operator to adjust the rotational speeds of the motors which drive the multitude of ductor rollers employed in the multicolor printing machine with the aid of centrally arranged indicating elements. However, in the known arrangements of this type, it is not the actual rotational speed (which, because of its coupling with the variable main machine drive, is not suited for use as an adjustment parameter) but rather the potentiometer angular displacement angle, the desired rotational speed, or another adjustment parameter which is adjusted instead, as disclosed, for instance, in the German Democratic Republic Patent DD-PS WP No. 125 618.

Regulation deviations of the control device which causes the rotational speed of the ductor roller to follow or be commensurate with the rotational speed of the main motor of the printing machine, as well as disturbing influences which are dependent on the speed or on the duration of operation of the printing machine, all of which cause the ductor roller printing ink layer thickness to vary, make it necessary for the printing machine operator to perform adjustment operations of the ductor roller rotational speeds both while the rotational speed of the main motor of the printing machine is being varied within the operational speed range of the main motor, and during the continuing operation of the printing machine even though the setting of the operating speed of the main motor is unchanged during such continuing operation, in such a manner as to maintain the supply of the printing ink per printing operation constant. Such an adjustment is currently being performed on the basis of the experience or intuition of the operating personnel, or only in reaction or response to color quality or color saturation in the printed product or the amount of misprints.

SUMMARY OF THE INVENTION

Accordingly, it is a general object of the present invention to avoid the disadvantages of the prior art.

Another object of the present invention is to develop a method of the above type which makes it possible to easily control the print quality of the printed product during the start-up of the printing machine operation as well as during the continuing operation of the printing machine at the normal operation speed throughout the operating speed range of the printing machine.

A further object of the present invention is to devise a control arrangement which is particularly suited for the performance of the above-mentioned method.

It is yet another object of the present invention so to design the arrangement of the type here under consideration as to be capable of furnishing normalized indication representative of the amount of printing ink being supplied to the printing ink spreading system of the printing station, regardless of the operating speed of the printing station.

An additional object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in a method of providing a normalized indication of the printing ink supply to at least one printing station of a printing machine including a main driving motor operating at a variable first rotational speed and a ductor roller driving motor which drives a ductor roller of the printing station and operates at an adjustable second rotational speed, this method comprising the steps of providing a first pulse train having a first pulse frequency proportional to the first rotational speed; generating a second pulse train having a second pulse frequency proportional to the second rotational speed; forming a ratio of the first and second pulse frequencies at predetermined settable time intervals; storing the thus formed ratio; and displaying the stored ratio.

The method of the present invention may be performed by a dedicated arrangement which will be discussed below, or by utilizing a computer system which performs cyclical measurements in accordance with a command succession stored in a non-volatile memory of the computer system.

Yet, in accordance with another aspect of the present invention, there is provided an arrangement which is especially suited for performing the above method, that is, for providing a normalized indication of the printing ink supply at least to one printing station of a printing machine including a main driving motor operating at a variable first rotational speed and a ductor roller driving motor which drives a ductor roller of the printing station and operates at an adjustable second rotational speed. This arrangement of the present invention comprises means for providing a first pulse train having a first pulse frequency proportional to the first rotational speed; means for generating a second pulse train having a second pulse frequency proportional to the second rotational speed; means for forming a ratio of the first and second pulse frequencies at predetermined settable time intervals; means for storing the thus formed ratio; and means for displaying the stored ratio. Advantageously, the providing means includes a first incremental digital transducer having an output, the generating means includes a second incremental digital transducer having an output, and the forming means includes a first gate circuit having an input connected to the output of the first incremental digital transducer, a control input and an output, a first counter with a settable counting volume having a counting input connected to the output of the first gate circuit, a resetting input and an output which is activated when the counting volume has been reached, a second gate circuit having an input connected to the output of the second incremental digital transducer, a control input and an output, a second counter having a counting input connected to the output of the second gate circuit, a resetting input and an output connected to the storing means, and a triggering circuit having one input connected to the output of the first incremental digital transducer and another input connected to the output of the first counter, the triggering circuit being operative for generating from the signals reaching the first and second inputs thereof a start/stop signal and a resetting signal and further having one output carrying the start/stop signal and connected to the control inputs of the first and second gate circuits and another output carrying the resetting signal and connected to the resetting inputs of the first and second counters. At least the display means is advantageously located remotely from the associated printing station.

It is further advantageous when, in accordance with another aspect of the present invention, the counting volume is set to be equal to the product of a factor $1/(v_2/v_1)$, wherein $v_2/v_1$ is a ratio of pulse rates of the second and first pulse trains per revolution of the ductor roller and main driving motors, respectively, and of the factor $100/(n_2/n_1)_{max}$, wherein $(n_2/n_1)_{max}$ is the maximum settable rotational speed ratio of the rotational speeds of the ductor roller and main driving motors.

This particular construction of the arrangement of the present invention offers the special advantage of such a normalization of the indication that a percentage ratio of the adjusted actual value with respect to the adjustable maximum value of the printing ink supply is presented. As a result of this, the operating personnel receives a direct visual indication of the relative change in the supplied printing ink amount in response to an adjustment operation. In this manner, the achievement of the desired goal of keeping the amount of the printing ink supplied to the printing station during the respective printing operation constant or even for purposefully changing this amount to compensate for disturbing influences is considerably simplified, and this is reflected in the quality of the printed products.

The novel features which are considered as characteristic of the invention are set forth in particular in the appended claims. The improved normalized indicating arrangement itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The sole FIGURE of the drawing is a simplified diagrammatic view of a normalized indicating arrangement in accordance with the present invention, and of so much of a printing machine employing the above arrangement as is needed for understanding the present invention.

DETAILED DESCRIPTION OF THE PREFERRED EMBODIMENTS

Referring now to the sole FIGURE of the drawing in detail, it may be seen that the reference numeral 1 has been used therein to identify a ductor roller of a printing station employing a normalized indication arrangement of the present invention. In the illustrated construction, the illustrated ductor roller 1 is representative of a plurality of such ductor rollers 1 that are employed in the respective printing machine embodying the present invention. Each ductor roller 1 is associated with a printing station of the printing machine and cooperates with a printing ink spreading or transfer system of such printing station.

The printing ink spreading system of the printing station is illustrated in the drawing, and will be explained in more detail below, as being of the swinging printing ink lifting roller type. However, it will be appreciated that the normalized indication arrangement of the present invention may just as well be used in conjunction with a printing ink film transfer spreading system which will also be discussed in some detail later. Yet, such a film transfer spreading system will not be specifically illustrated in the drawing in order not to unduly encumber the same, since the construction and operation of such a system are well known and no illustration of such a construction is necessary for understanding the construction and operation of the normalized indication arrangement of the present invention.

The ductor roller 1 of the illustrated swinging lifting roller printing ink spreading system is caused to rotate about an axle 1*a* and has a ductor box or printing ink receptacle 1*b* associated therewith. The ductor box 1*b* contains a supply 1*c* of the printing ink to be transferred to the printing ink spreading system. As the ductor roller 1 rotates about the axle 1*a*, it picks up a layer of the printing ink from the supply 1*c* and entrains this layer for travel in its circumferential direction, until this layer reaches an area at which it is presented to a lifting roller 2 of the spreading system. The lifting roller 2 is mounted for rotation about an axle on a lever 2*b* which, in turn, is mounted for swinging or pivoting motion about a pivot axle 2*c*. As illustrated, a spring 2*d* urges the lever 2*b* in the clockwise direction, while a cam 4 which turns about an axle 4*a* displaces a cam follower roller 2*f*, which is mounted on the lever 2*b* for rotation about an axle 2*e*, causes displacement of the lever 2*b* in the counterclockwise direction against the force of the spring 2*d*. This counterclockwise angular displacement of the lever 2*b* eventually causes the lifting roller 2 to temporarily contact the ductor roller 1 and accept printing ink therefrom during the period of engagement therewith, while the subsequent angular displacement of the lever 2*b* in the clockwise direction under the influence of the spring 2*d* eventually brings the lifting roller 2 into contact with a first transfer roller 3 of the printing ink spreading system, this first transfer roller 3 being rotatable about an axis 3*a*. The rest of the spreading and printing system is well known and not needed for understanding the present invention, so that it has been omitted from the drawing for the sake of clarity.

A main driving motor 5 of the printing machine or of the printing station operates at a rotational speed $n_1$ which may be varied in dependence on the printing requirements. A converter 6 of a conventional construction, such as a mechanical step-down transmission, converts the rotational speed $n_1$ of the main driving motor 5 into an operational rotational speed $n_H$. The control cam 4 is caused to turn at this operational rotational speed $n_H$, as indicated by a broken line 4*b*. On the other hand, the shown ductor roller 1 is driven in rotation by a ductor roller driving motor 9.1 while other ductor rollers (non-shown) are driven by motors 9.2, or 9.3. Each motor operates at a rotational speed $n_2$.

In the drawing, the elements connected to and corresponding to the shown ductor roller 1 have been identified by reference numerals followed by suffix 0.1 whereas those elements which have the same construction and function but associated with the ductor rollers 1 than ductor roller 1 have been identified by the same reference numerals but followed by suffixes 0.2, or 0.3.

Using the above convention, it may be seen that converter 10.1 (which may again be a mechanical step-down transmission) converts the output rotational speed $n_2$ of the ductor roller driving motor 9.1 into a ductor roller operational speed $n_D$ which is then used, as indicated by a broken line 1*d*, to rotate the shown ductor roller 1.

As already mentioned before, during the operation of the arrangement as discussed so far, the alternating angular displacement or swinging motion of the lever 2*b* causes the lifting roller 2 to temporarily contact the ductor roller 1. When this happens, a narrow strip of the printing ink having a thickness $s_H$, a width $b_H$ (which corresponds to the printing machine or station printing width) and a length $l_H$ as considered in the circumferential direction of the lifting roller 2 is lifted by the lifting roller 2 from the ductor roller 1. The amount of the printing ink which is supplied to the printing ink spreading system during one complete to-and-fro swinging motion of the lever 2*b* and thus of the lifting roller 2 corresponds to the volume of the printing ink strip transferred by the lifting roller 2. When the ductor roller printing ink layer thickness is constant, the supplied printing ink amount is proportional to the strip length $l_H$ (provided that disturbing influences are disregarded). The absolute value of the printing ink strip can be determined from the following equation:

$$l_H[mm] = U_D[mm]\cdot(\Delta t_H/t_H)\cdot(n_D/n_H),$$

wherein $U_D$ is the circumferential length of the ductor roller 1, $\Delta t_H/t_H$ represents the contact ratio of the lifting roller 2 with the ductor roller 1 (relative duration of the contact with respect to the duration of the lifting roller swinging motion), and $n_D/n_H$ represents the rotational speed ratio of the lifting roller 2 with respect to the cam 4. Inasmuch as the rotational speed $n_H$ of the cam 4 is positively dependent on the rotational speed $n_2$ of the main driving motor 5 (due to the action of the converter 6), the following equation applies as well:

$$l_H[mm] = c_H[mm]\cdot(n_2/n_1),$$

wherein $c_H$ is a machine constant and $n_2/n_1$ represents the rotational speed ratio of the ductor driving motor 9.1 with respect to the main driving motor 5.

The aforementioned normalized indication arrangement according to the present invention is illustrated in the accompanying sole FIGURE of the drawing to the extent necessary for understanding the present invention. The components incorporated in the circuitry of this normalized indication arrangement are of conventional constructions and are readily available, so that their structure will not be described in any detail.

It may be seen that a first incremental rotational displacement transducer or sensor 7 picks up the instantaneous value of the variable rotational speed $n_1$ of the main driving motor 5 and, as is well known, generates a train of pulses the frequency of which is indicative of the rotational speed $n_1$. The output of the transducer 7 is connected via a first gate circuit 17 with a counting input C of a first pulse counter 18 which has an adjustable counting volume m.

A further incremental rotational displacement transducer or sensor 11.1 picks up the instantaneous value of the variable rotational speed $n_2$ of the ductor roller driving motor 9 and generates another train of pulses the frequency of which is indicative of the rotational speed $n_2$. The output of the transducer 11 is connected via a second gate circuit 20.1 with a counting input C of a second pulse counter 21.1.

There is further provided a triggering circuit 19 having a first input connected to the output to the transducer 7, while an output m of the first pulse counter 18, which is activated upon the reaching of the count m in the first pulse counter 18, is connected to a second input of the triggering circuit 19. The triggering circuit 19 is operative for generating a start/stop signal and a resetting signal. A first output of the triggering circuit 19, on which the start/stop signal appears, is connected to control inputs of the gate circuits 17 and 20.1, while a second output of the triggering circuit 19, on which the resetting signal appears, is connected to resetting inputs of the pulse counters 18 and 21.1.

It is of course understood that the circuits including the elements identified with the same reference numerals added with suffixes 0.2 and 0.3 operate in connection with other non-shown ductor rollers in the same mode as described herein above for the shown ductor roller 1.

The counting result output of the pulse counter 21.1 which is associated with the ductor roller driving motor 9.1 is connected with a digital storage device 22.2, in which the counting result can be stored upto the inputting of a new counting result. The output of the digital storage device 22.2 is connected to an associated group 23.1 of numerical value indicating or display elements, the group 23.1 being associated with the respective printing station of the printing machine but being situated remotely of its associated printing station at a central location, together with all the other groups 23.2; 23.3, etc. of indicating or display elements.

During the operation of the printing machine, the first incremental rotational displacement transducer 7 produces a first pulse train with a frequency proportional to the rotational speed $n_1$ of the main driving motor 5, and this first pulse train is supplied to the first gate circuit 17 and to the triggering circuit 19. The second incremental rotational displacement transducers 11.1; 11.2; 11.3, etc. (of which three are shown in the drawing, but more or less of which may be provided as well) produce respective second pulse trains, each with a frequency proportional to the respective rotational speed $n_2$ of the associated ductor roller driving motor 9.1; 9.2; 9.3, and each of these second pulse trains is supplied to the associated second gate circuit 20.1; 20.2; 20.3.

The triggering circuit 19 derives its start signal from the first pulse of the first pulse train reaching the same, and this start signal is operative for activating the gate circuits 17 and 20.1; 20.2; 20.3, respectively. The pulse counters 18 and 21.1; 21.2; 21.3, respectively begin to count the incoming pulses reaching the same through the activated data circuits 17 and 20.1; 20.2; 20.3, respectively, commencing with the next pulse of the respective first or second pulse train following the start signal. When the counter 18 has reached its predetermined m-th counting step, it activates its output m, and the triggering circuit 19 derives it stop signal and its resetting signal from this activated output signal of the counter 18. The stop signal makes the gate circuits 17 and 20.1; 20.2; 20.3 non-conductive.

The digital storage devices 22.1; 22.2; 22.3 take over the respective counting results from the associated counters 21.2; 21.2; 21.3, and store these results upto the next-following inputting of the new counting results. The resetting signals issued by the triggering circuit 19 resets the pulse counters 19 and 21.1; 21.2; 21.3 to their initial condition. The stored counting results are furnished to the associated display element groups 23.1; 23.2; 23.3 and are displayed thereby.

The counting volume m of the pulse counter 18 is so adjusted as to correspond, as far as its value is concerned, to the product formed from the factor $1/(v_2/v_1)$ with the ratio of the pulse rates generated per revolution of the ductor driving motor 9.1; 9.2; 9.3 and of the main driving motor, respectively, as well as the factor $100/(n_2/n_1)_{max}$ with the maximum adjustable rotational speed ratio of the respective ductor driving motor 9 and the main driving motor 5.

It may also be seen in the drawing that the reference numeral 16 has been used to identify a circuitry which includes the components 17 to 21.2 and constitutes a digital pulse frequency ratio measuring arrangement. Furthermore, the drawing shows that the first and second pulse trains are additionally supplied respectively to a first and to a second digital-to-analog converter 8 and 12.1. The analog signal from the converter 8 is supplied in the circuit for the ductor roller 1 to a potentiometer 13.1 having a tap that is connected to one input of a subtracting component 14.1, while the analog signal from the converter 12.1 is supplied to another input of the subtracting component 14.1. The output of the subtracting component 14.1 is then connected through a rectifying component 15.1 to a control input of the ductor roller driving motor 9.1 to control the rotational speed thereof. Thus, it may be seen that the ratio of the rotational speed $n_2$ of the ductor roller driving motor motor 9.1 to the rotational speed $n_2$ of the main driving motor 5 can be adjusted to the potentiometer 13.1 and that, once adjusted, it will be maintained practically constant due to the feedback loop through the converter 12.1. As a result of this, the indication provided by the display element group 23.1 will be normalized, that is, it will be dependent on the ratio $n_2/n_1$ but independent of the main driving motor rotational speed $n_1$. In other words, for the same setting of the potentiometer 13.1, the indication provided by the display element group 23.1 will be virtually the same, regardless of the rotational speed $n_1$. Consequently, it is a particular advantage of the normalized indication arrangement of the present invention that it indicates the percentage ratio of the set (actual) value to the adjustable maximum value of the printing ink supply.

As already mentioned before, the normalized indication arrangement of the present invention is not restricted to the use with the lifting roller printing ink spreading system. Rather, it may also be used in the same manner as discussed above in conjunction with a printing ink film transfer spreading system. When using the system of the last-mentioned type, a transfer roller which rotates at the same circumferential speed as the printing plate cylinder picks up a circumferentially complete partial layer from the layer presented by the ductor roller, and this partial layer is subsequently transferred to an elastic roller arranged downstream of the transfer roller. When a ductor roller printing ink layer thickness $s_D$ is maintained constant, the supplied amount of the printing ink is proportional to a thickness $s_U$ of the partial layer present on the transfer roller (provided again that disturbing influences are disregarded). The following equations are applicable for the absolute value of the transferred layer thickness $s_U$:

$$s_U[\mu m]=s_{De}[\mu m]\cdot(v_D/v_U),$$

or $$s_U[\mu m]=s_{De}[\mu m]\cdot(R_D/R_U)\cdot(n_D/n_U),$$

wherein $S_{De}$ is the effective ductor roller printing ink layer thickness (because of the presence of the previously mentioned gap between the ductor roller and the transfer roller, less than the entire thickness $s_D$ of the ductor roller printing ink layer participates in the printing ink transfer to the transfer roller), $v_D/v_U$ is the ratio of the circumferential speeds of the ductor roller and of the transfer roller, $R_D/R_U$ is the ratio of the radii of the ductor roller and of the transfer roller, and $n_D/n_U$ is the ratio of the rotational speeds of the ductor roller and of the transfer roller. Inasmuch as even here the rotational speed of the transfer roller is positively dependent on the printing machine rotational speed, the following equation is applicable, analogously to the lifting roller printing ink spreading system, to the film transfer printing ink spreading system:

$$s_U[\mu m]=c_F\cdot(n_2/n_1),$$

wherein $c_F$ is a machine constant and $n_2/n_1$ is a ratio of the rotational speeds of the ductor driving motor and of the main driving motor.

Consequently, in the film transfer spreading system, like in the lifting roller transfer system, the printing ink supply is ultimately proportional to the rotational speed ratio $n_2/n_1$ of the rotational speeds of the ductor driving motor and of the main driving motor. Thus, the above-explained normalized indication arrangement of the present invention may be used in the same manner as described above in conjunction with the lifting roller printing ink spreading system for providing a normalized indication for a film transfer roller printing ink spreading system.

It will be understood that each of the elements described above, or two or more together, may also find a useful application in other types of arrangements differing from the type described above.

While the invention has been illustrated and described as embodied in a normalized indication arrangement for a multicolor printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific agents of our contribution to the art and, therefore, such adaptations should and are intended to be comprehended within the meaning and range of equivalence of the claims.

What is claimed as new and desired to be protected by Letters Patent is set forth in the appended claims.

1. An arrangement for providing a normalized indication of the printing ink supply to at least one printing station of a printing machine including a main driving motor operating at a variable first rotational speed and a ductor roller driving motor which drives a ductor roller of the printing station and operates at an adjustable second rotational speed, comprising means for providing a first pulse train having a first pulse frequency proportional to the first rotational speed; means for generating a second pulse train having a second pulse frequency proportional to the second rotational speed; means for forming a ratio of said first and second pulse frequencies at predetermined settable time intervals; means for storing the thus formed ratio; and means for displaying the stored ratio, said providing means including a first incremental digital transducer having an output; wherein said generating means includes a second incremental digital transducer having an output; and wherein said forming means includes a first gate circuit having an input connected to said output of said first incremental digital transducer, a control input and an output, a first counter with a settable counting volume having a counting input connected to said output of said first gate circuit, a resetting input and an output which is activated when said counting volume has been reached, a second gate circuit having an input connected to said output of said second incremental digital transducer, a control input and an output, a second counter having a counting input connected to said output of said second gate circuit, a resetting input and an output connected to said storing means; and a triggering circuit having one input connected to said output of said first incremental digital transducer and another input connected to said output of said first counter, said triggering circuit being operative for generating from the signals reaching said first and second inputs thereof a start/stop signal and a resetting signal and further having one output carrying said start/stop signal and connected to said control inputs of said first and second gate circuits and another output carrying said resetting signal and connected to said resetting inputs of said first and second counters.

2. The arrangement as defined in claim 1, wherein said counting volume is set to be equal to the product of a factor $1/(v_2/v_1)$, wherein $v_2/v_1$ is a ratio of pulse rates of said second and first pulse trains per revolution of the ductor roller and main driving motors, respectively, of the factor $100/(n_2/n_1)_{max}$, wherein $(n_2/n_1)_{max}$ is the maximum settable rotational speed ratio of the rotational speeds of the ductor roller and main driving motors.

* * * * *